US005918761A

United States Patent [19]

Wissinger

[11] Patent Number: 5,918,761

[45] Date of Patent: Jul. 6, 1999

[54] VACUUM INSULATED TRAVEL MUG

[75] Inventor: John W. Wissinger, Freeport, Ill.

[73] Assignee: The Thermos Company, Freeport, Ill.

[21] Appl. No.: 08/744,589

[22] Filed: Nov. 6, 1996

[51] Int. Cl.[6] ..... B65D 53/02; A47G 19/22

[52] U.S. Cl. ..... 220/713; 220/62.18; 220/304; 220/378; 220/592.17; 220/710.5; 220/758

[58] Field of Search ..... 220/758, 304, 220/288, 703, 710.5, 711, 713, 719, 420, 425, 421, 469, 714, 715, 468, 712, 716, 717, 718, 592.17, 378, 62.18; 229/403

[56] References Cited

U.S. PATENT DOCUMENTS

| | | | |
|---|---|---|---|
| 3,972,443 | 8/1976 | Albert | 220/378 X |
| 4,238,045 | 12/1980 | D'Andria | 220/714 |
| 4,303,173 | 12/1981 | Nergard | 220/715 X |
| 4,473,161 | 9/1984 | Zimmerman | 220/420 X |
| 4,489,840 | 12/1984 | De Freitas | 220/713 X |
| 5,145,107 | 9/1992 | Silver et al. | 220/468 X |
| 5,297,686 | 3/1994 | Takeuchi | 220/758 X |
| 5,456,380 | 10/1995 | Ito et al. | 220/713 |
| 5,477,979 | 12/1995 | Goessling et al. | 220/713 |
| 5,515,995 | 5/1996 | Allen et al. | 220/719 X |
| 5,553,731 | 9/1996 | Schuyler | 220/719 |

*Primary Examiner*—Stephen Castellano
*Assistant Examiner*—Niki M. Eloshway
*Attorney, Agent, or Firm*—Wood, Phillips, VanSanten, Clark & Mortimer

[57] ABSTRACT

An insulated container and cover construction comprises an outer container shell (24) terminating in an opening (26) having a surrounding edge (28), an inner container shell (30) nested within the outer container shell (24) and having an opening (32) surrounded by a continuous edge (34) in abutment with the surrounding edge (26). The inner container shell (30) is otherwise spaced inwardly and generally out of contact with the outer container shell (24). A cover mounting assembly 49, 52 is mounted on the outer container shell 24 adjacent the opening 26. A single seal ring (38) of elastomeric material has a first sealing surface (42) disposed at the interface of the shells 24, 30 and the cover mounting assembly 49, 52 to seal the same and a second inwardly facing sealing surface (48) overlies the opening (32) of the inner container shell (30). Locating rings (49), (52) define the cover mounting assembly and locate the single sealing ring (38) on the inner and outer container shells (24) and (30) and a cover (12) is removably mounted on the container and has a sealing surface (70) in sealing engagement with the second sealing surface (48) on the sealing ring (38).

14 Claims, 4 Drawing Sheets

FIG. 4
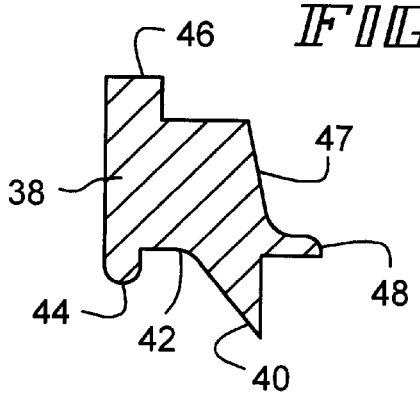
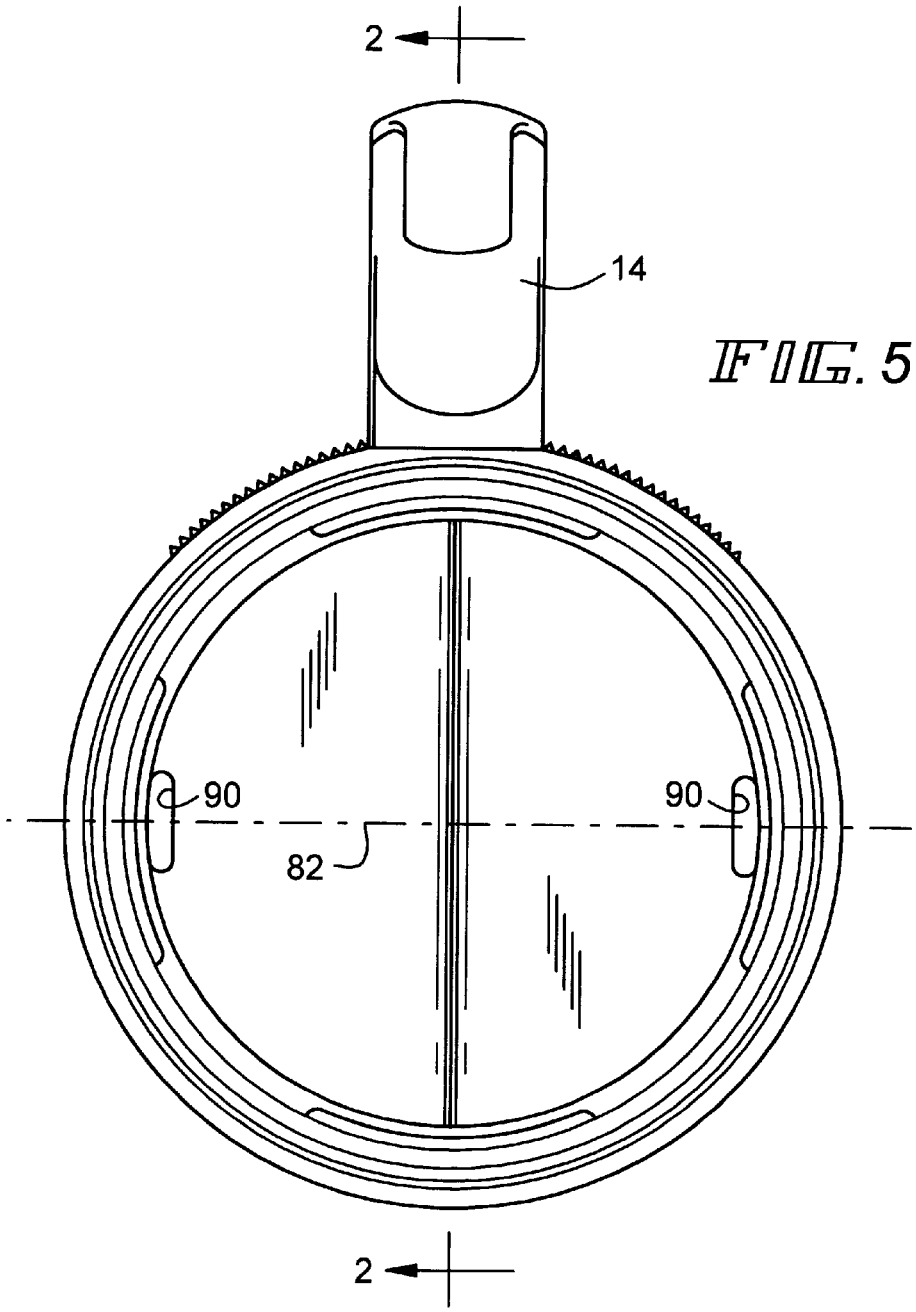
FIG. 5

VACUUM INSULATED TRAVEL MUG

FIELD OF THE INVENTION

This invention relates to insulated containers provided with covers, and more particularly, to such a container that is suited for use as a travel mug.

BACKGROUND OF THE INVENTION

Recent years has seen a considerable upsurge in the popularity of so-called "travel mugs". A typical travel mug includes a container for a beverage and is fitted with a removable cover. Conventionally, the cover will be provided with a mouth piece or an opening of limited size through which the beverage may be withdrawn by the user of the mug.

This configuration allows considerable sloshing of the beverage within the mug without spilling because the limited size of the opening through the cover or the mouth piece is such as to substantially confine all of the liquid.

Frequently, the opening may be at the bottom of a recess in the cover. Thus, to the extent that a beverage may pass through the opening to the exterior of the mug and remain in the recess, it will drain back into the mug, again preventing the spilling of the beverage.

Travel mugs have been made of various materials. Inexpensive travel mugs may amount to a single plastic container provided with a removable cover of the type mentioned above. Somewhat more sophisticated travel mugs may include nested and spaced containers to provide a foamed space, a dead air space, or even a vacuum, space between the two containers. Again, plastic material may be employed in some of these constructions.

Unfortunately, the very nature of the use of a travel mug is such that it is subject to considerable rough handling. As a consequence, the container may crack and leak if the mug is a vacuum-type mug, the vacuum is lost and the insulating qualities of the vacuum lost with it.

Furthermore, many materials used in travel mugs scratch readily and as a result of rough handling, such scratching may substantially detract from the appearance of the mug.

Thus, there is a real need for a travel mug of tough construction that may stand up to considerable rough handling and remain both functional and pleasing in its aesthetic appearance. The present invention is directed to fulfilling that need.

SUMMARY OF THE INVENTION

It is the principal object of the invention to provide a new and improved container and cover construction. More specifically, it is an object of the invention to provide a new and improved container and cover construction that is ideally suited for use as a rugged travel mug of pleasing appearance.

An exemplary embodiment of the invention achieves the foregoing objects in a construction including a container assembly having an upper opening and a cover mounting assembly including a ring mounted to the container assembly at the upper opening. A single seal ring of elastomeric material has a first sealing surface sealing the interface of the container assembly and the cover mounting assembly along with a second, inwardly facing sealing surface overlying the container upper opening in surrounding relation thereto. A cover is removably received on the cover mounting assembly over the container upper opening and has a peripheral sealing surface in sealing engagement with the second sealing surface.

In a highly preferred embodiment, a handle is disposed on the cover mounting assembly.

Preferably, the container assembly includes an outer container shell terminating in an opening having a surrounding edge with an inner container shell nested within the outer container shell. The inner container shell has an opening surrounded by a continuous edge in abutment with the surrounding edge of the outer shell with the remainder of the inner container shell otherwise being spaced inwardly and generally out of contact with the outer container shell. Typically, the shell edges will be welded together.

As a result of the foregoing, a potential leakage path between container assembly and the cover mounting assembly is sealed by a single seal which additionally acts as the seal between the cover and the cover mounting assembly, thereby performing two functions with but a single element to provide economical construction. The space between the two container shells may be evacuated to provide a vacuum insulation space. Further, the construction lends itself to manufacture using metal inner and outer containers which are rugged and which may be polished to provide a pleasant aesthetic appearance.

In a preferred embodiment of the invention, the inner container shell has an outwardly directed flange and the continuous edge of the inner container shell is defined by the underside of such flange.

In one embodiment of the invention, the seal ring includes a bottom side with a notch therein. The flange and the surrounding edge are received in the notch.

In one embodiment of the invention, the second sealing surface is defined by a radially inwardly directed nose. Preferably, the sealing surface on the cover is a generally cylindrical surface which engages the inward directed nose.

In one form of the invention, the container shells have radially outward directed flanges surrounding their respective openings and the edges are defined by abutting surfaces of the flanges that in turn define the interface sealed by the single seal ring.

In a preferred embodiment, the surrounding edge is defined by a radially outwardly directed flange and the locating means comprises a first threaded ring surrounding the outer container in underlying relation to the flange and a second threaded ring threaded on the first ring and sandwiching the seal at the interface.

Preferably, the second threaded ring includes additional threads and the cover includes threads for removable engagement with the additional threads.

In one embodiment, a handle extends from the second ring.

In a highly preferred embodiment, the cover includes an upper, central recess, a ridge dividing the recess into two pockets, and an opening in each pocket extending to the other side of the cover at a location inwardly of the cover sealing surface.

Other objects and advantages will become apparent from the following specification taken in connection with the accompanying drawings.

DESCRIPTION OF THE DRAWINGS

FIG. 4 is a fragmentary, sectional view of a seal ring used to seal the interface; and FIG. 5 is a plan view of an embodiment of the invention.

DESCRIPTION OF THE PREFERRED EMBODIMENT

Figure 1:
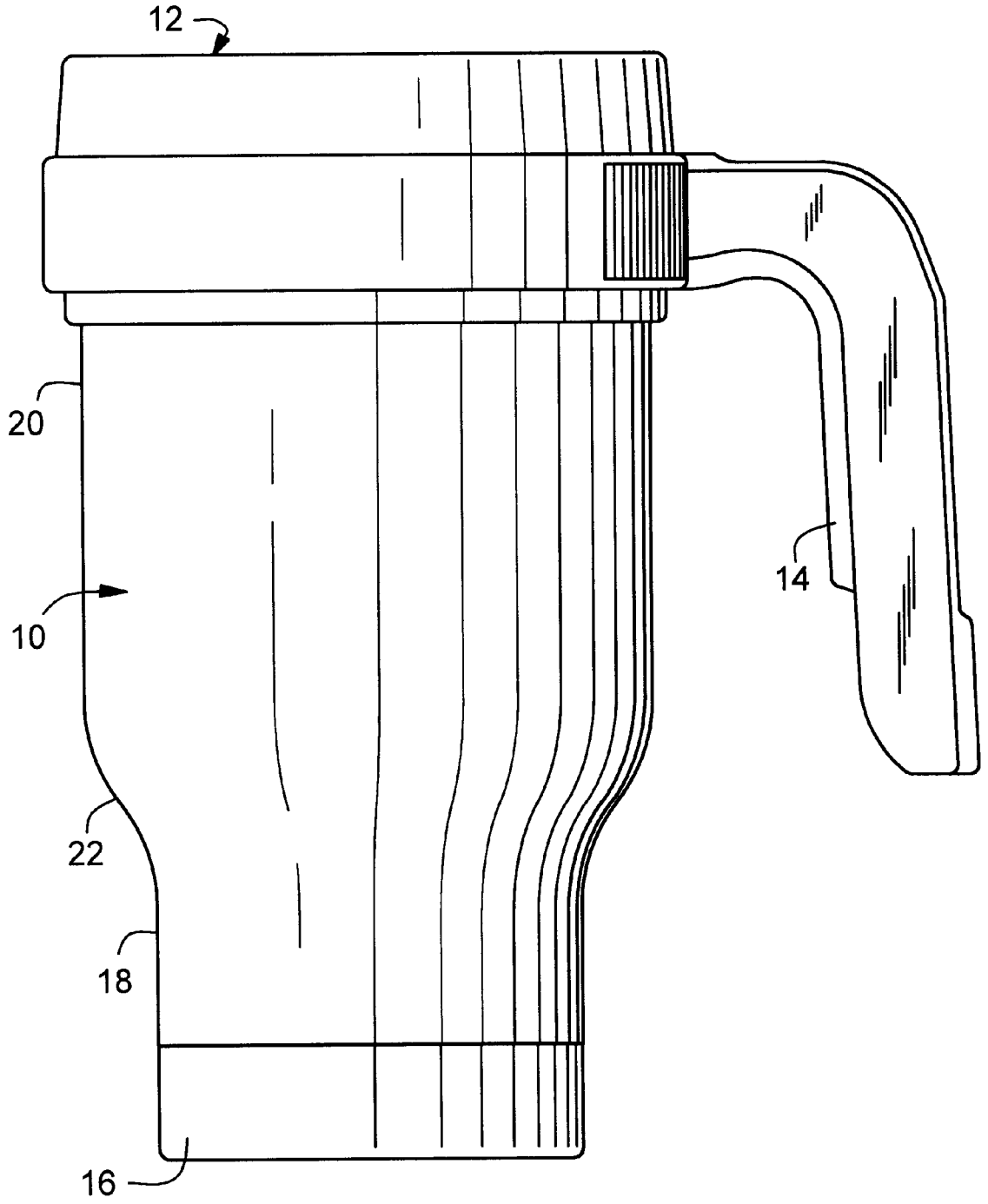
FIG. 1 is a side elevation of a container and cover construction made according to the invention.

An exemplary embodiment of the invention is illustrated in the drawings in the form of a travel mug. However, it is to be understood that the principles of the invention will find utility in other applications involving containers provided with covers where insulation of the container is required. Accordingly, it is to be recognized that the invention is not to be limited to a travel mug except insofar as so restricted in the appended claims.

Figure 2:
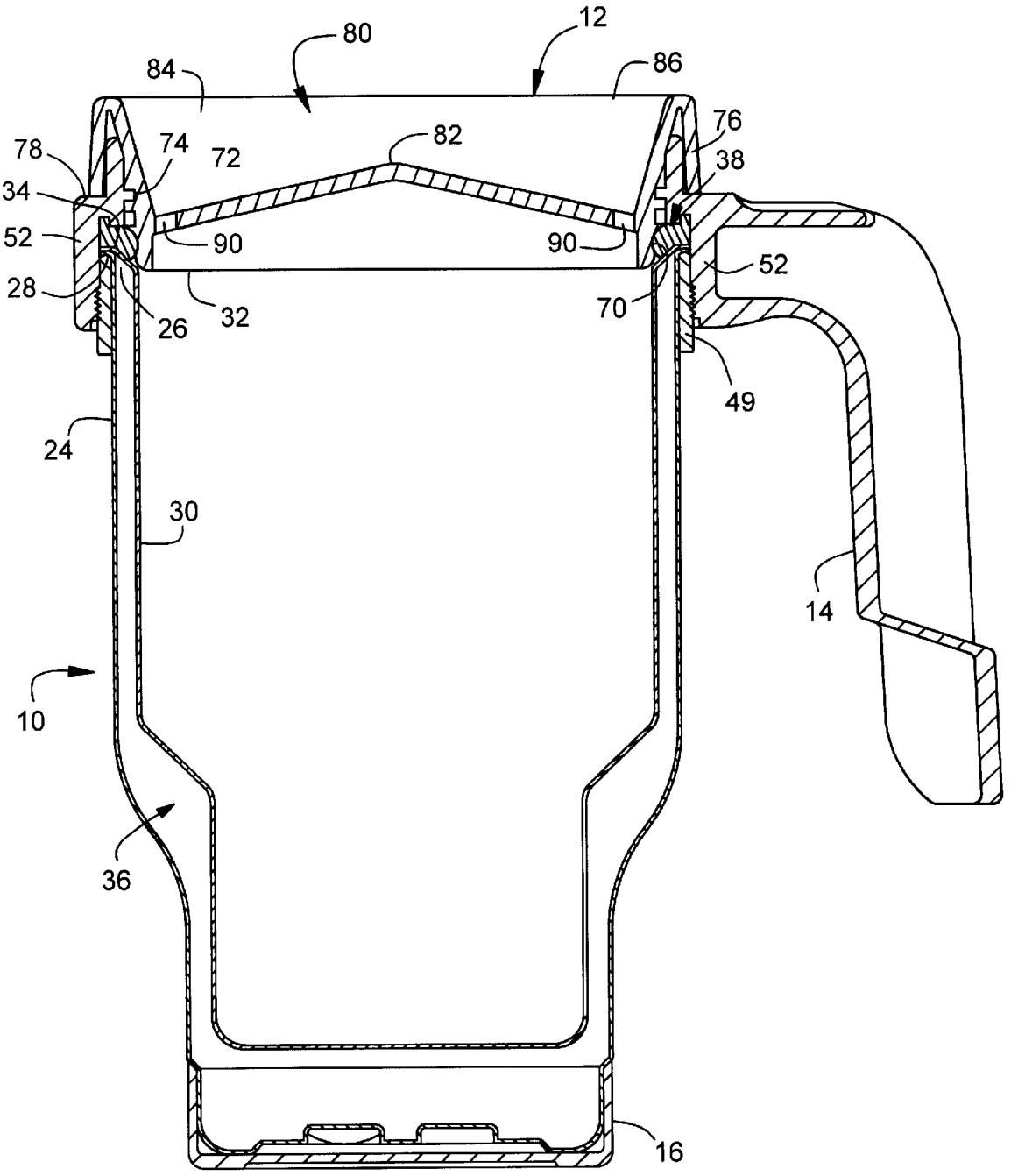
FIG. 2 is a vertical sectional view of the container and cover construction taken approximately along the line 2—2 in FIG. 5.

Referring to FIGS. 1 and 2, the mug includes a container, generally designated 10, fitted with a removable lid, generally designated 12. A handle 14 is fitted to the container for gripping the same.

Generally speaking, the container 10 will be formed of metal as, for example, stainless steel or the like. At its lowermost end, it may optionally be fitted with a shallow, cup-like foot 16 formed of a plastic having a greater coefficient of friction than the metal of which the container 10 is formed to prevent the same from readily sliding on a flat surface.

As can be seen, the container 10 has a lower, small diameter section 18 and an upper, large diameter section 20 with a blending section 22 disposed between the two. Typically, the small diameter section 18 will be of a diameter like that of a conventional hot cup or the like so that the container 10 may be received readily in a cup holder designed for receiving such cups. Through the use of the larger diameter upper section 20 and the small diameter lower section 18, such cup holders may be appropriately used and yet the capacity of the container 10 made relatively large.

Figure 3:
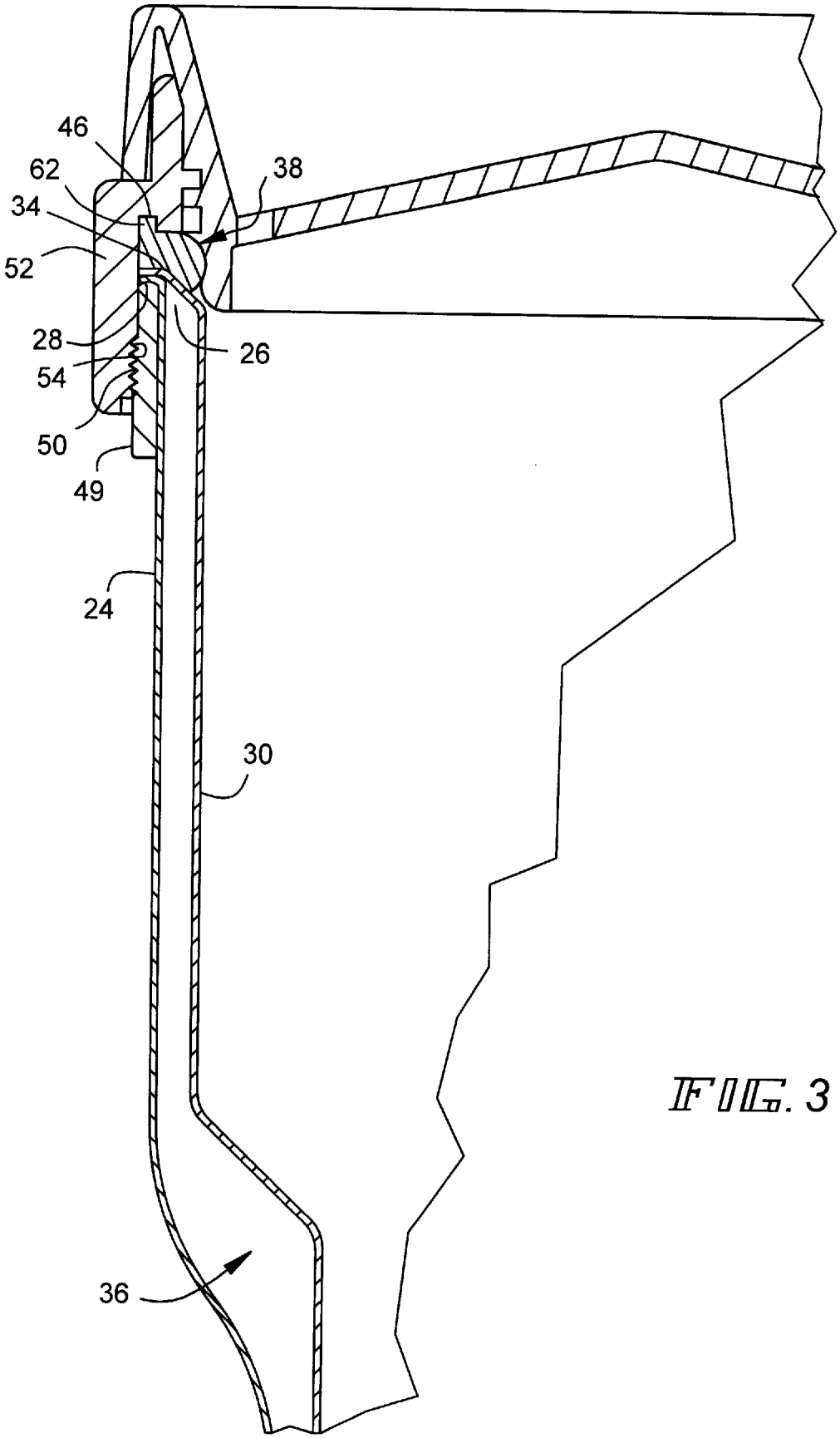
FIG. 3 is an enlarged, fragmentary vertical sectional view of the interface of an inner and outer container shell employed in the invention.

As best seen in FIG. 2, the container 10 includes an outer container shell 24, typically of metal such as stainless steel, terminating in an upper opening 26 that includes a surrounding edge in the form of a radially outwardly directed flange 28 (also seen in FIG. 3). Nested within the outer shell 24 is a metal, typically stainless steel, inner container shell 30. The inner container shell also includes an upper opening 32 surrounded by a radially outwardly directed flange 34 (shown also in FIG. 3). As best seen in FIG. 3, the flanges 34 and 28 are in abutment with one another to define an interface between the inner and outer shells 24 and 30. Typically, the two will be welded together. It will also be appreciated from FIG. 2 that the inner and outer shells 24 and 30 are spaced from one another so as to provide an insulating space 36. While the space 36 could be occupied by an insulating material such as a foam, or even could simply be a dead air space, it is preferred that the space is subject to a vacuum.

Referring to FIG. 4, the single sealing ring 38 is made of any suitable elastomeric material and includes a lower or bottom side 40 that is provided with a notch 42 shaped to conform to the flange 34 on the inner container 30. A downwardly directed peripheral lip 44 is located at the radially outer extremity of the notch 42.

At its upper surface, the sealing ring 38 includes an upwardly directed lip 46. The radially inner surface of the sealing ring 38 is designated 47 and is in the form of a sealing surface or nose 48 which seals against the cover 12 as will be seen.

Referring specifically to FIGS. 2–4, the seal 38 is held in place by a first rigid mounting ring 49 having an exterior threaded surface 50 and sized to fit about the outer shell 24 to abut in underlying relation, the flange 28. A second rigid mounting ring 52 has a first set of threads 54 on its interior which threadably engage with the threads 50 on the first mounting ring 49. As seen in FIG. 2, the handle 14 is integral with the mounting ring 52. The mounting rings 49 and 52 serve as a handle and cover mounting assembly.

Both the mounting ring 49 and the mounting ring 52 may be made of any suitable plastic.

The mounting ring 52 includes a radially inwardly located clamping surface 60. Just radially outward of the clamping surface 60 is an axially opening seal locating groove 62 in which the flange 46 on the seal 38 is received. Thus, the clamping surface 60 bears against the upper surface of the seal 38 and when the first and second rings 49 and 52 are threaded together, the seal 38 is sandwiched in the position illustrated in FIGS. 2 and 3 with the flange 44 sealing the interface between the welded flanges 28 and 34 and the handle and the cover mounting assembly defined by the mounting rings 49 and 52. At the same time, the nose 48 extends into the opening 32 of the inner shell 30 and abuts a sealing surface 70 of generally cylindrical configuration forming the lower part of the cover 12. Thus, the seal 38 provides the dual function of sealing a potential leakage path between the shells 24 and 30 on the one hand and the inner ring 49 and outer ring 52 on the other, as well as sealing the cover 12.

Preferably, the cover 12 is made of plastic and includes exterior threads 72 of conventional construction. On its interior, the second sealing ring 52 may include an additional set of threads 74 which removably engage the threads 72 to hold the cover 12 in place on the container 10. The cover 12 may also include an axially directed peripheral flange 76 that abuts against the shoulder 78 on the second ring 52 to act as a stop for purposes to be seen.

As seen in FIGS. 2 and 5, the cover 12 includes a central recess, generally designated 80. A diametric ridge 82 is located in the recess and divides the same into two pockets 84 and 86.

At the lowermost point in each of the pockets 84 and 86 small oval, drain openings 90 are located. The openings 90 are angularly spaced 180° and extend through the cover 12 to a location inwardly of the sealing surface 70 thereon. As a consequence, any liquid that remains in the recess 80 will flow down the bottom wall of the respective pocket to reenter the container through the appropriate one of the openings 90.

The stop action provided by the shoulder 78 is such as to orient the openings 90 so as to be angularly spaced by 90° from the handle 14 as is apparent from FIG. 5. This allows the mug to be gripped by the handle 14 with either hand and still present the user with one of the openings 90 through which the beverage in the container may be sipped. That is to say, with this particular arrangement, the user of the mug need not shift it from one hand to the other, or rotate a cover to properly orient an opening such as the opening 90 in order to achieve easy access thereto.

From the foregoing, it will be appreciated that an insulated container and cover construction made according to the invention is ideally suited for use as a travel mug. The use of nesting inner and outer shells 24 and 30 allow the use of stainless steel or other decorative metal for forming the mug to provide a rugged construction and a pleasant appearance. They also provide a means whereby a vacuum space may be formed with the seal 38 serving to not only seal the vacuum space, but provide a seal for the cover 12 when placed on the container 10 as well. The use of the dual drinking openings 90 and their orientation with respect to the handle 14 provide an additional measure of convenience of use.

We claim:

1. A travel mug comprising:

a container assembly having an upper opening:

a cover mounting assembly including a ring separate from and mounted to said container assembly at said upper opening;

a single seal ring of elastromeric material having a first sealing surface extending between two opposing, facing surfaces to seal said container and said cover mounting assembly, said container assembly having one of said opposing surfaces and said cover mounting assembly having the other of said opposing surfaces and a second sealing surface at said container upper opening in surrounding relation thereto; and a cover removably received on said cover mounting assembly over said container upper opening and having a peripheral sealing surface in sealing engagement with said second sealing surface.

2. The travel mug of claim 1 further including a handle on said cover mounting assembly.

3. A travel mug comprising:

a container having cover receiving threads about an opening to the interior of said container;

a cover removably threaded to said cover receiving threads, said cover having an upper, central recess divided into opposed pockets by a generally diametric ridge, each of said pockets having a drain/drink openings, with said drain/drink openings being angularly spaced about 180°;

a handle extending from one side of said container; and stop means on said cover and said container for angularly locating said cover on said container with said drain/drink openings angularly spaced from said handle about 90°;

whereby said handle may be gripped with either hand and one of said drain/drink openings will be easily accessible.

4. An insulated container and cover construction comprising:

an outer container shell terminating in an opening having a surrounding edge:

an inner container shell nested with said outer container shell and having an opening surrounded by a continuous edge in abutment with said surrounding edge, said inner container shell otherwise being spaced inwardly of and generally out of contact with said outer container shell;

a rigid ring separate from but mounted on said shells and located closely adjacent said openings;

a single seal ring of elastomeric material having a first sealing surface sealingly engaging said inner shell, said outer shell and said rigid ring; and a second sealing surface surrounding said inner container opening;

means, including said rigid ring, for locating said single seal ring on said inner and outer container shells; and a cover removably mounted on said inner and outer container shells and having a sealing surface in sealing engagement with said second sealing surface.

5. The insulated container and cover construction of claim 4 wherein said inner container shell has an outwardly directed flange, said continuous edge being defined by the underside of said flange.

6. The insulated container and cover construction of claim 5 wherein said single seal ring includes a bottom side and a notch in said bottom side, said flange and said surrounding edge being received in said notch.

7. The insulated container and cover construction of claim 6 wherein said second sealing surface is defined by a radially inward directed nose.

8. The insulated container and cover construction of claim 4 wherein both said container shells have radially outward directed flanges surrounding their respective openings and said edges are defined by abutting, welded surfaces of said flanges.

9. The insulated container and corner construction of claim 4 wherein said cover sealing surface is a generally cylindrical surface.

10. The insulated container and cover construction of claim 4 wherein said surrounding edge is defined by a radially outwardly directed flange and said locating means comprises a first threaded ring surrounding said outer container in underlying relation to said flange and a second threaded ring defining said rigid ring and threaded on said first ring.

11. The insulated container and cover construction of claim 10 wherein said second ring includes additional threads and said cover includes threads for removable engagement with said additional threads.

12. The insulated container and cover construction of claim 11 wherein said cover includes an upper central recess, a ridge dividing said recess into two pockets, and an opening in each pocket extending to the other side of the cover at a location inwardly of said cover sealing surface.

13. The insulated container and cover construction of claim 12 further including a handle extending from one side of said second ring.

14. The insulated container and cover construction of claim 13 further stop means between said cover and said second ring and located to orient said openings at about 90° to said handle.

* * * * *